US005641342A

United States Patent [19]

Smith et al.

[11] Patent Number: 5,641,342

[45] Date of Patent: Jun. 24, 1997

[54] INTERLOCK BETWEEN CELLS OF AN ELECTRONIC AIR CLEANER

[75] Inventors: Ronald R. Smith, Indianapolis, Ind.; Joseph C. Summa, Tyler, Tex.

[73] Assignee: Carrier Corporation, Syracuse, N.Y.

[21] Appl. No.: 578,261

[22] Filed: Dec. 26, 1995

[51] Int. Cl.[6] ..... B03C 3/82

[52] U.S. Cl. ..... 96/77; 55/481; 55/506; 96/86

[58] Field of Search ..... 96/30, 77, 80, 96/86, 84, 100; 55/481, 496, 506, 509

[56] References Cited

U.S. PATENT DOCUMENTS

| | | | |
|---|---|---|---|
| 3,626,668 | 12/1971 | Cardiff | 55/481 X |
| 3,735,560 | 5/1973 | Wellman | 55/481 X |
| 4,042,357 | 8/1977 | Gysi | 55/481 X |
| 4,268,282 | 5/1981 | MacKenzie | 55/481 X |
| 4,290,788 | 9/1981 | Pittman et al. | 55/481 X |
| 4,869,736 | 9/1989 | Ivester et al. | 96/100 |
| 5,071,455 | 12/1991 | Abedi-Asl | 96/86 X |

*Primary Examiner*—Richard L. Chiesa

[57] ABSTRACT

An interconnection is made between a pair of electrostatic air cleaner cells which are placed in side-by-side relationship within a housing, such that when one is removed from the housing, the other is also removed.

2 Claims, 10 Drawing Sheets

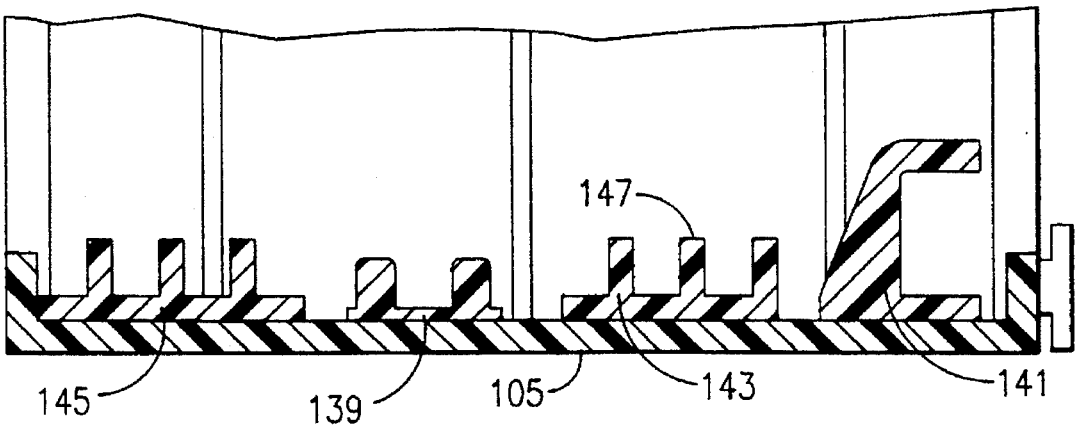
FIG.11
FIG.12
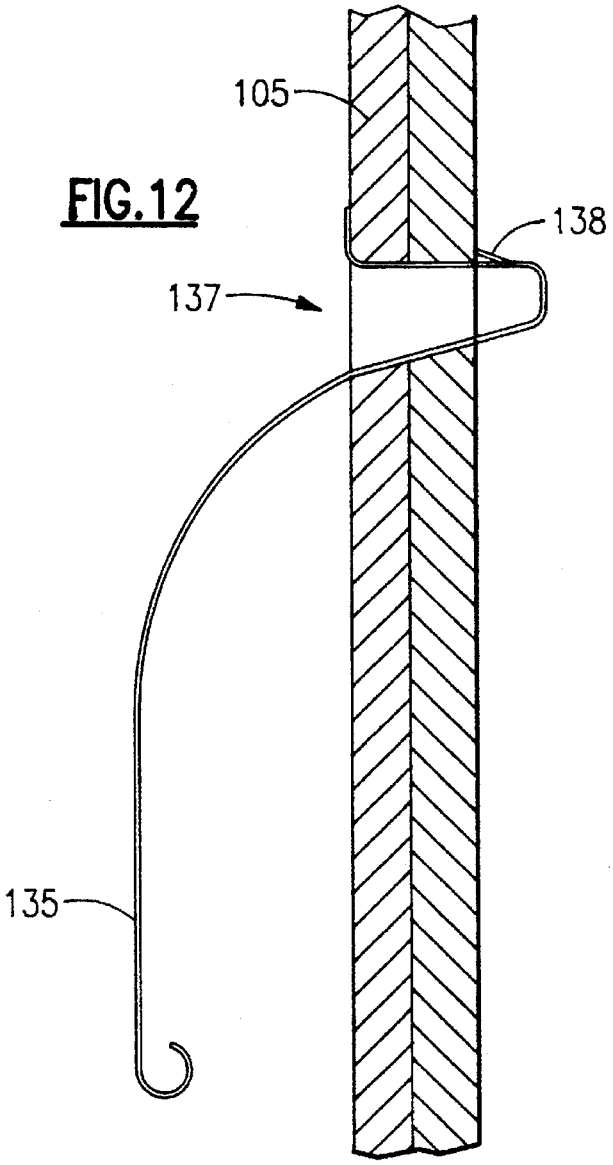
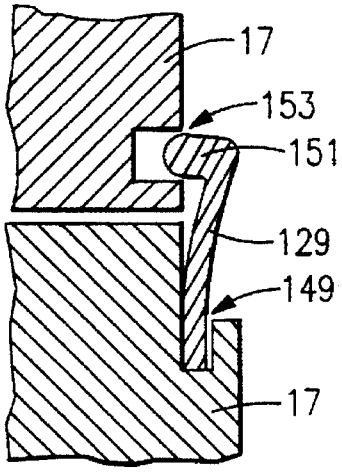
FIG.13

INTERLOCK BETWEEN CELLS OF AN ELECTRONIC AIR CLEANER

BACKGROUND OF THE INVENTION

This invention relates generally to electrostatic air cleaning devices and, more particularly, to an improved method and apparatus for interlocking a pair of installed cells.

It is common practice in the manufacture of electronic air cleaner units to provide a heavy duty housing structure or cabinet into which a pair of electrostatic air cleaner cells are placed in side-by-side relationship for the purpose of purifying or cleaning the air that passes axially therethrough. As the air passes first through the ionizing section, the dust particles are caused to be charged with high voltage electricity. Those charged particles are then removed from the air stream as they pass through the collector section and are deposited on the negatively charged or grounded, collector plates. As the deposits of dust particles build up on these collector plates, it is periodically necessary to dean the units. This may be accomplished by removing the entire air cleaner unit including the housing structure with its contained cells, and washing the dust deposits from the collector plates by use of a pressurized air or water stream. Alternatively, and preferably, an end plate may be removed from the housing so as to allow the removal of the individual cells from the housing. Those cells can then be placed in a dishwasher, for example, to clean the collector plates. This may be accomplished without removing the housing from the system, thereby reducing complications and the labor involved in the disassembly and reinstallation.

In the process of removing the individual cells, it is relatively easy, after removing the end cover, to remove the cell adjacent thereto. However, in order to remove the other installed cell, it is necessary for an owner or serviceman to extend an arm into the opening and grasp the side of the cell in order to slide it out. This can be rather threatening and difficult because of the inability to see within the installed housing. Further, the cell is not likely to have a handle or the like that is easily grasped, so as to easily facilitate the removal of the cell unit, which can be relatively heavy.

It is therefore an object of the present invention to provide an improved electrostatic air cleaner structure.

Another object of the present invention is the provision in an electrostatic air cleaner for easily removing a pair of side-by-side cells from a housing.

Yet another object of the present invention is the provision for an electrostatic air cleaner cell which is easily removed from its housing.

Still another object of the present invention is the provision for an electrostatic air cleaner structure which is economical to manufacture and effective and efficient in use.

These objects and other features and advantages become more readily apparent upon reference to the following description when taken in conjunction with the appended drawings.

SUMMARY OF THE INVENTION

Briefly, in accordance with one aspect of the invention, a pair of electrostatic air cleaner cells, which are adapted to be placed in side-by-side relationship within a housing, are provided with an interconnection means which causes both of the cells to be withdrawn from the housing when one of the cells is withdrawn.

In accordance with another aspect of the invention, a clip member is installed on the lateral edge of one of the cells, so as to extend beyond the lateral edge thereof, and a clip receiving indent is provided near a lateral edge of the other cell, near its lateral side adjacent the first cell, such that when the first cell is installed adjacent the second cell, the clip member engages the indent of the second cell. Thus, when the first cell is slid out of the housing, the clip will cause the second cell to also be withdrawn.

By yet another aspect of the invention, the clip member is spring loaded in such a manner that when the second cell is installed adjacent to the first cell, the clip member is initially caused to move against the bias of the spring and then to be moved into engagement with the indent as the first cell is further inserted into position.

In the drawings as hereinafter described, a preferred embodiment is depicted; however, various other modifications and alternate constructions can be made thereto without departing from the true spirit and scope of the invention.

BRIEF DESCRIPTION OF THE DRAWINGS

FIG. 11 is a partial sectional view of one of the side walls of the cell as seen along lines 11—11 in FIG. 9.

FIG. 12 is a partial sectional view of the side wall with a clip installed therein.

FIG. 13 is a partial sectional view of an installed interconnect clip in accordance with the present invention.

DESCRIPTION OF THE PREFERRED EMBODIMENT

Figure 1:
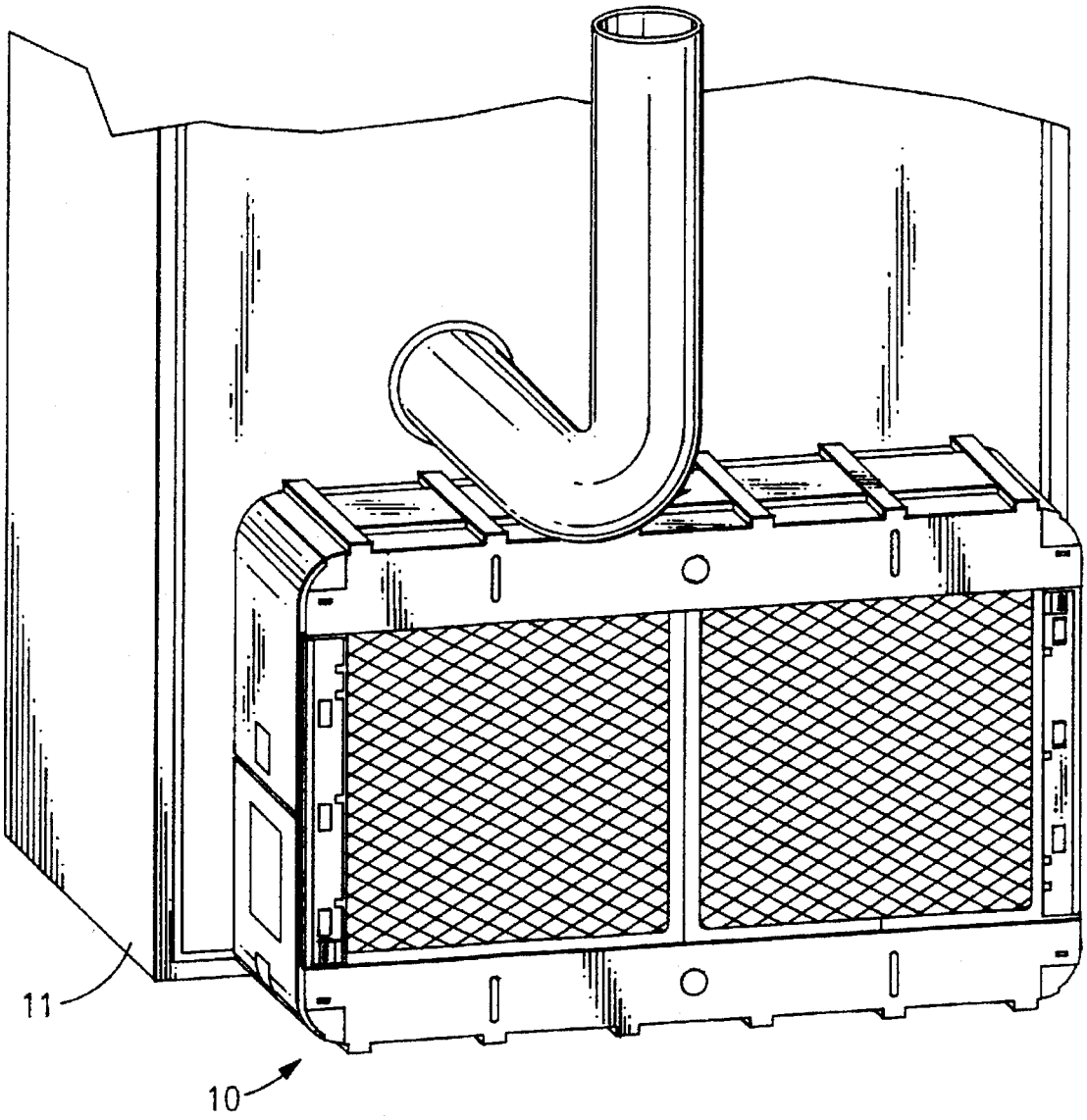
FIG. 1 is a perspective view of an installed electronic air cleaner in accordance with the present invention.

Referring now to FIG. 1, the air cleaner assembly of the present invention is shown generally at 10 as applied to the side of an upflow furnace 11. In such an installation, the circulation air blower in the furnace 11 causes air to flow from the room, back through the return air duct (not shown), through electronic air cleaner 10 and into the furnace 11, where it is either heated by the furnace or cooled by an air conditioner evaporator coil mounted at the top of the furnace (not shown).

As alternatives to the side mounted installation as described above, the electronic air cleaner 10 may be mounted below the furnace (for an upflow furnace), or above the furnace (for a downflow furnace). In any case, the air cleaner is installed between the return air duct and the air circulation fan. The particular manner in which the air cleaner assembly 10 is installed within the system is not important for purposes of describing the present invention. However, it is important to recognize that the design of the air cleaner assembly 10 is adaptable to various installation requirements, such that the size of the air cleaner assembly can match the capacity requirements of the particular furnace installation without the use of special adaptation or structures.

Figure 2:
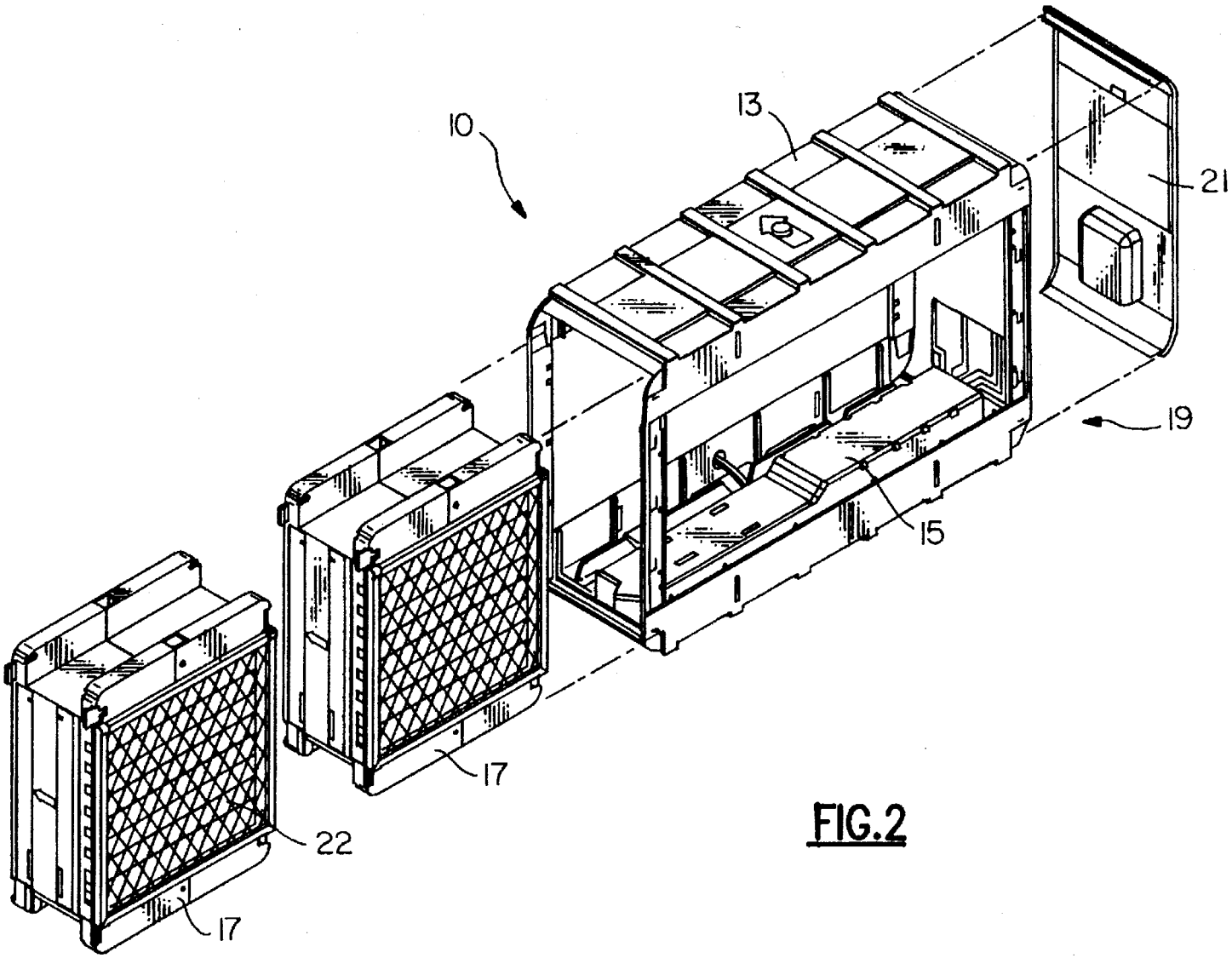
FIG. 2 is an expanded view of portions thereof.

As will be seen in FIG. 2, the air cleaner assembly 10 comprises a containment assembly or casing 13, into which there is installed a power supply tray 15 at the bottom thereof, and a pair of identical air cleaner cells 17 placed in lateral side-by-side relationship so as to fill the opening 19 through which the air to be cleaned is longitudinally drawn. A door 21 is installed on each lateral end of the casing 13 to complete, and close, the structure. The power supply tray 15 is semi-permanently installed (i.e. it is only removed for replacement purposes), whereas the cells 17 are periodically removed from the casing 13 for purposes of cleaning. A mechanical screen filter 22 is preferably installed on the upstream side of each cell 17 as shown.

Figure 3C:
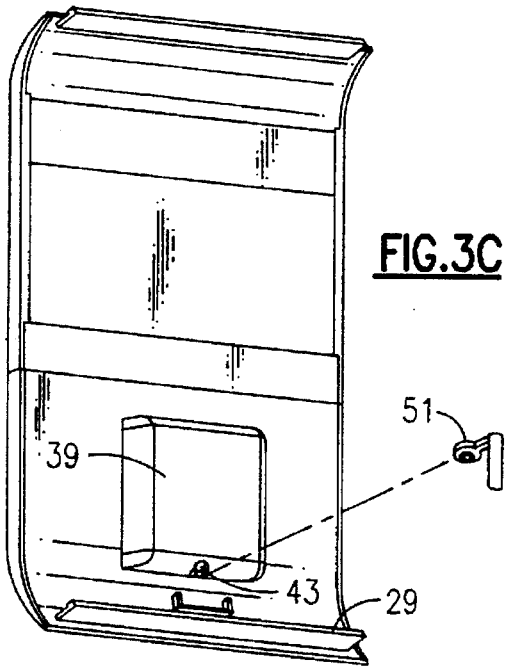
FIGS. 3A, 3B and 3C are expanded perspective views of a door portion thereof.
Figure 3A:
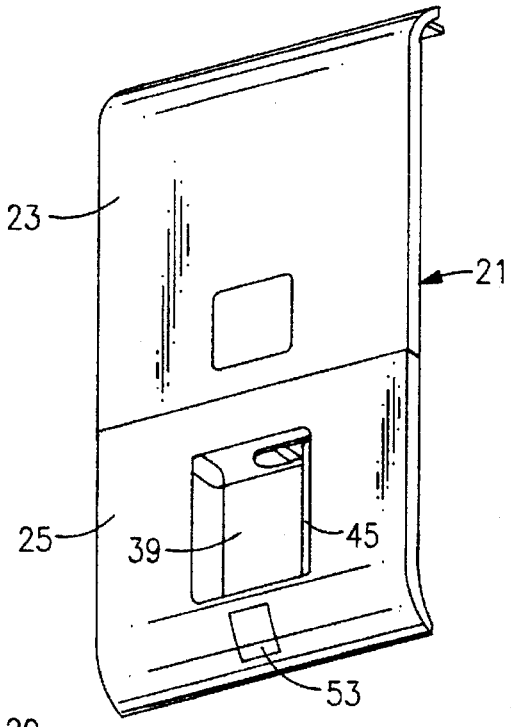
Figure 3B:
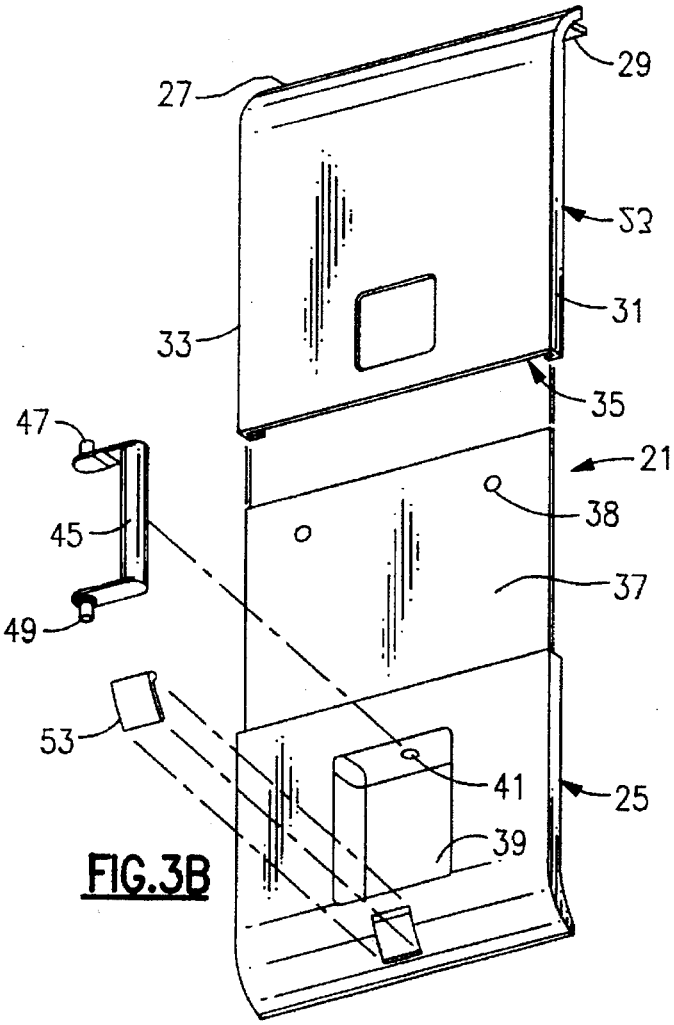

Referring now to FIGS. 3A and 3B, a door 21 is shown to include upper section 23 and lower section 25. The upper section 23 has a curved transverse end that 27 matches a similar curve in the casing 13, and has on its inner side a locking flange 29 that allows it to be locked into place by engagement with a similar flange in the casing 13. A pair of track sidewalls 31 and 33 define a track 35 for slideably receiving, in a telescopic manner, a tongue portion 37 of the lower section 25. Each of the doors 21 can therefore be adjusted in length to accommodate varying sizes of casings as will be described more fully hereinafter. Dimples (not shown) are provided in one part to engage with indents 38 of the other part to lock the two in their extended positions. In one of the doors, the door lower section 25 includes a handle indent housing 39 with openings 41 and 43 in the bottom and top thereof, respectively. A handle 45 is provided with top pivot post 47 and top pivot post 49 adapted for being spring loaded into the top and bottom openings, 41 and 43, respectively. Secured to the top post 49 is a crank 51, which interfaces with a switch, to be described hereinafter, for shutting down the power when the door is opened. In operation, when the crank handle 45 is in its secured position as shown in FIG. 3A, the crank 51 will be in such a position as to hold the switch on to activate the system (i.e. to allow the power to be applied thereto). However, when the handle 45 is pulled out of the indent housing 39, the crank 51 is caused to rotate to thereby release the switch to inactivate the power.

Figure 4:
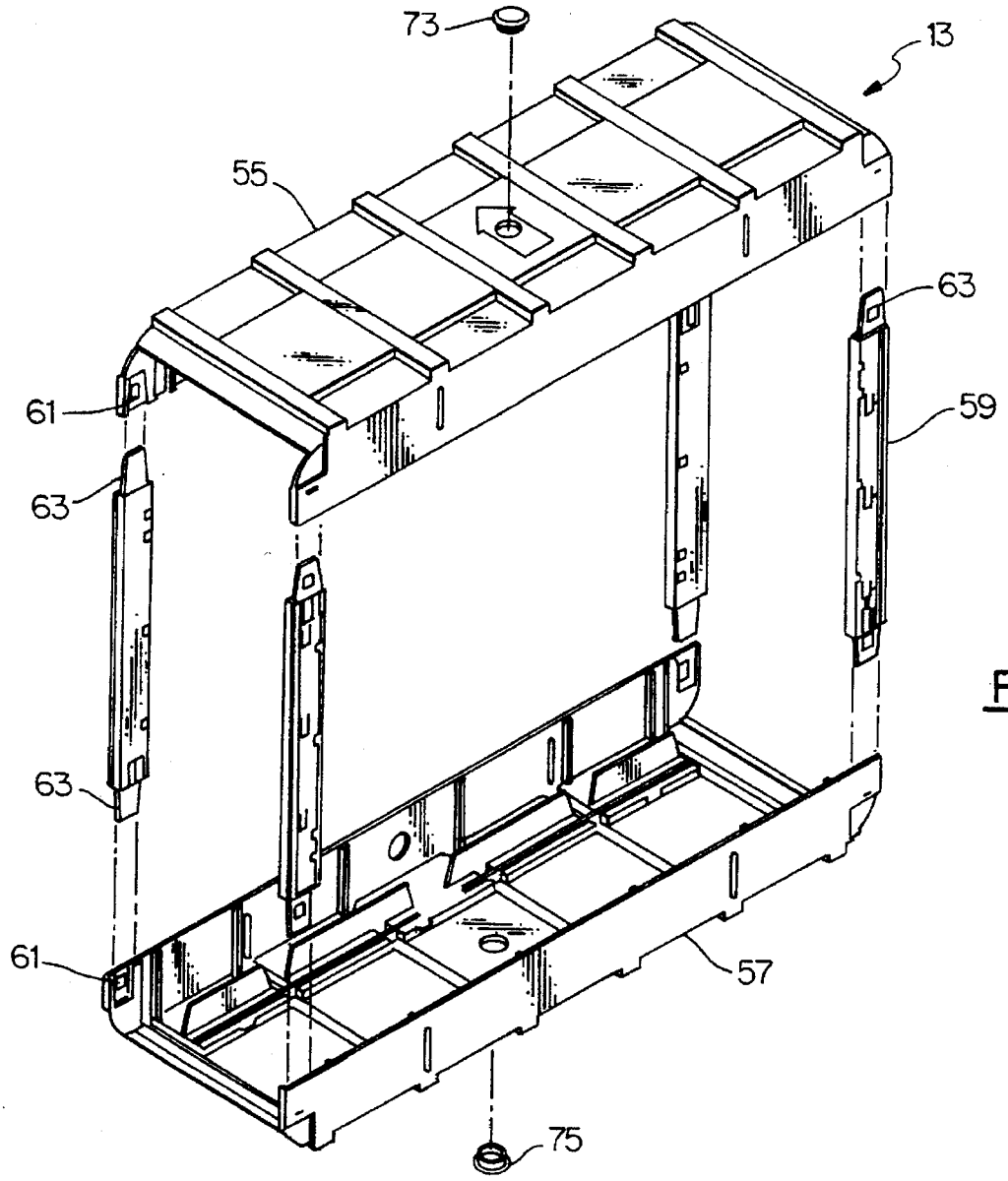
FIG. 4 is an expanded view of the casing portion thereof.
Figure 5:
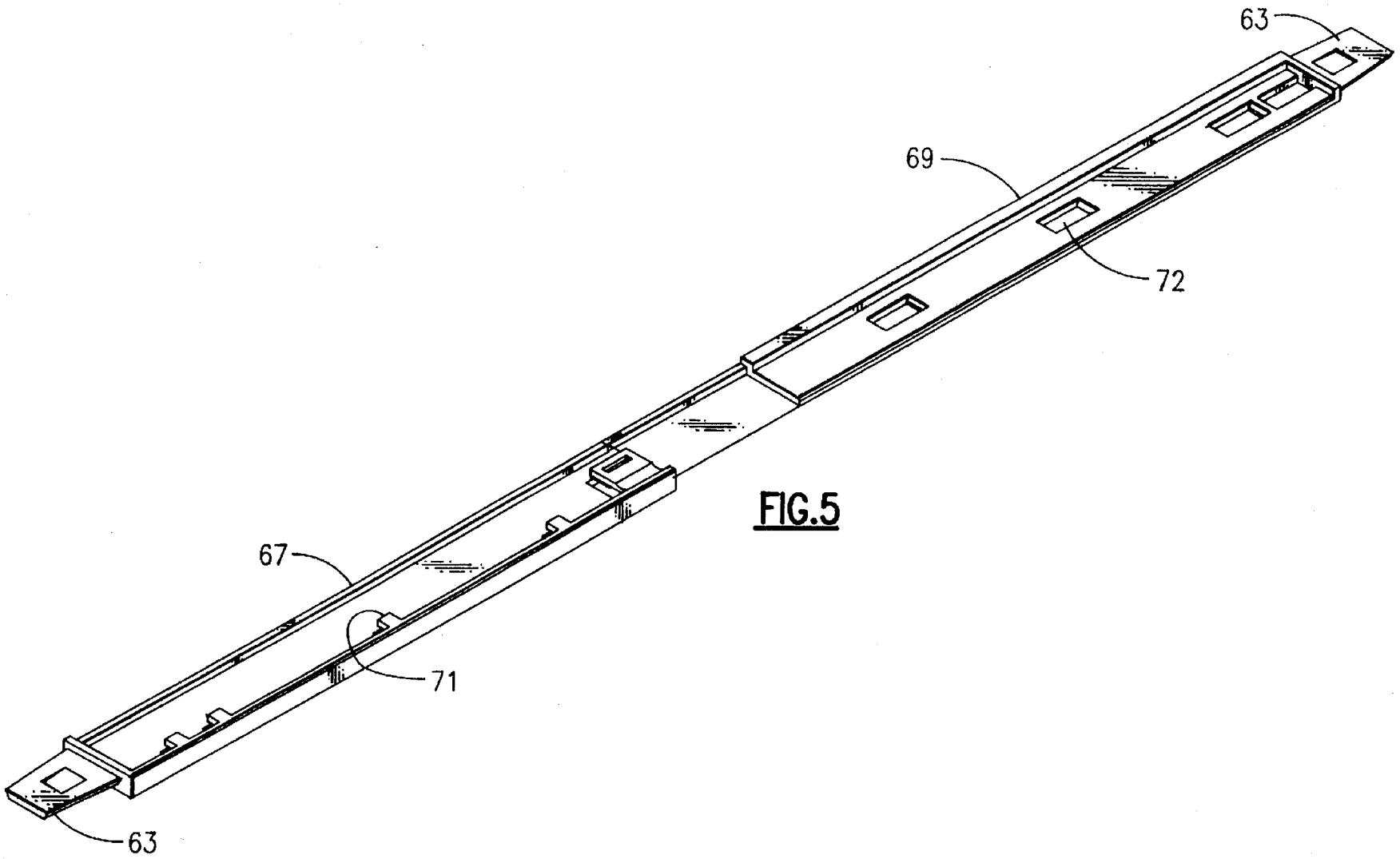
FIG. 5 is a perspective view of an expandable leg portion thereof.

The casing 13 as shown in FIG. 4 includes an upper wall 55, lower wall 57, and four identical expandable support members or legs 59. In each of the four comers of the upper 55 and lower wall 57, there are provided slots 61 for receiving the tongues 63 of the expandable legs 59. As will be seen in FIG. 5, each of the expandable legs comprises inner 67 and outer 69 members telescopically inter connected so as to permit the transverse height of the casing 13 to be adjusted according to the particular size of the cells that are to be installed. When adjusted to the proper length, the tube 71 in one part engages with holes 72 in the other part to lock the two in their relative positions, so as to fix that length and provide a rigid structure into which the cells can be installed. For example, although the width of the casing 13 is fixed, the heights of the cells are changed to accommodate various sizes of cells, such as cells capable of 1400 CFM and 2000 CFM, for example. The same casing 13 can be used for each of these sizes simply by expanding the legs 59 to the desired length.

The upper 55 and lower 57 walls have openings with plugs 73 and 75, respectively. These can be removed to accommodate the entry of electrical leads into the casing. For example, the bottom plug 75 may be removed for bringing in the leads to the power source, while the top plug 73 remains in place. The casing 13 components are preferably made of a moldable plastic having high strength characteristics, such as LEXAN®.

Figure 6:
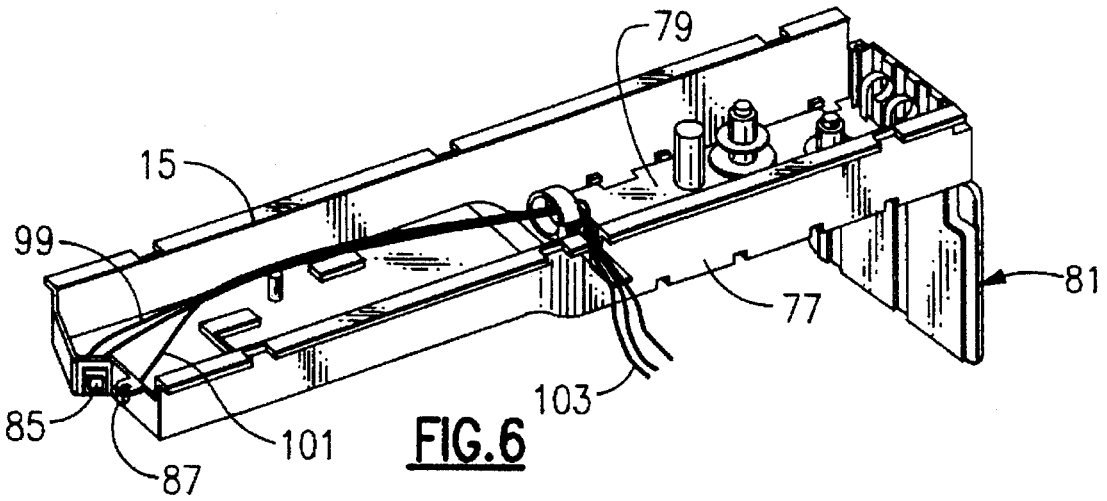
FIG. 6 is a perspective view of a power supply tray portion thereof.
Figure 7:
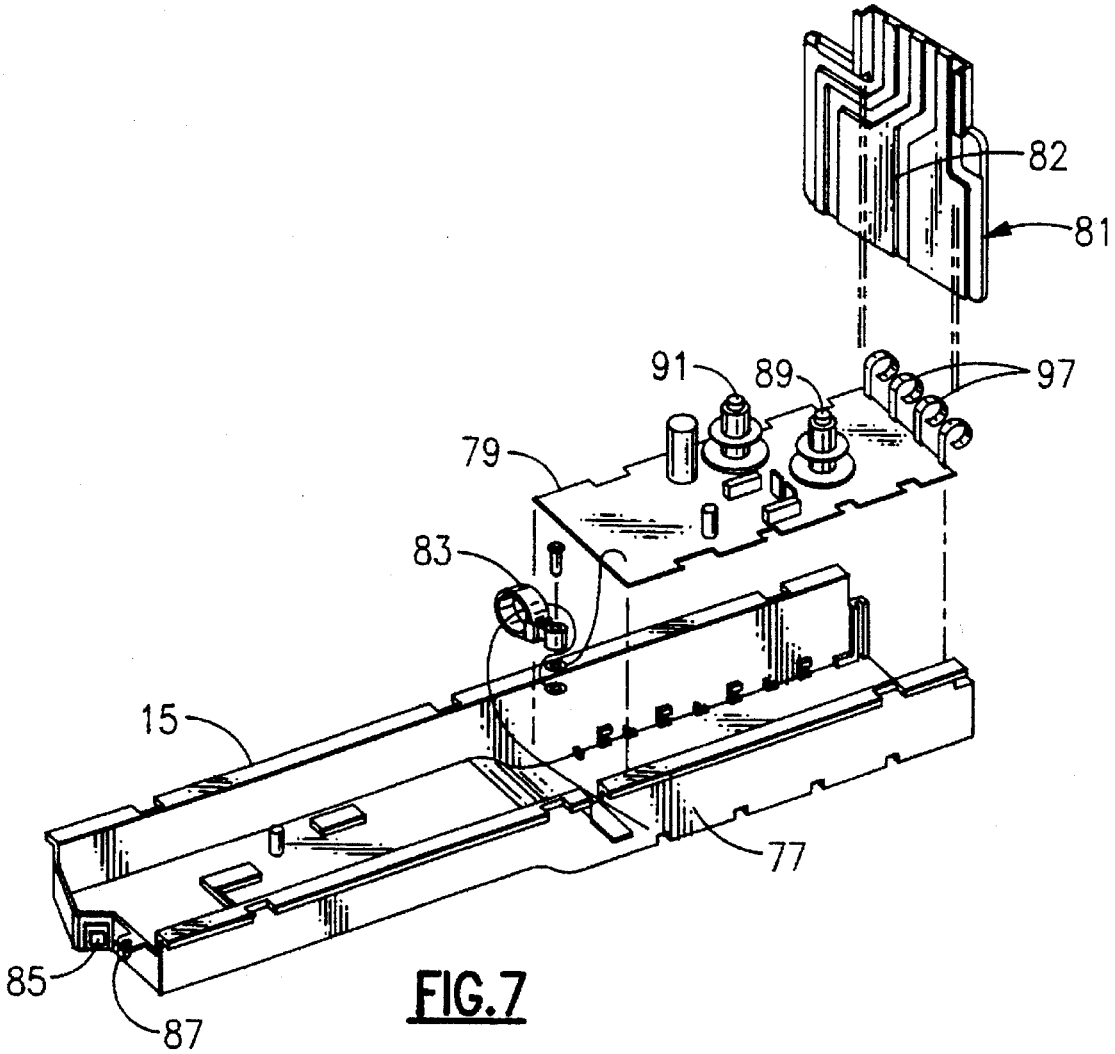
FIG. 7 is an expanded view thereof.

Referring now to FIGS. 6 and 7, the power supply tray 15 includes a base 77 into which a circuit board 79 and a back wall 81 are installed. Trace circuits 82 are attached to the back wall 81. A wire tie 83 is provided near the center thereof, and a switch 85 and an indicator LED 87 are provided at one end thereof. The circuit board 79 includes transformer 91, and a plurality of stainless steel circuit contacts 97. A pair of leads 99 provide for electrical interconnection between the switch 85 and the circuit board 79. Leads 101 electrically interconnect LED 87 to the circuit board 79. And leads 103 electrically interconnect the circuit board 79 to a 115 V source.

In operation, power flows into the leads 103, to the switch 85. If the switch 85 is open, as would occur when the door handle 45 is pulled out, no power will flow past the switch 85. If it is closed by the crank 51 linked to the door handle 45, then 115 V power flows to the circuit board 79 where it is transformed to useful voltage levels to be provided to the circuit contacts 97. Thus, one of the contacts 97 will receive voltage of 8500 volts, one at 7500 volts and two at ground voltage level. By direct engagement with the back wall 81, the contacts 97 establish their respective voltage levels on the trace circuits 82 in the back wall 81. They, in turn, are engaged by contacts in the cells, in a manner to be described, to establish the appropriate voltage levels in the appropriate parts of the cells.

Figure 8:
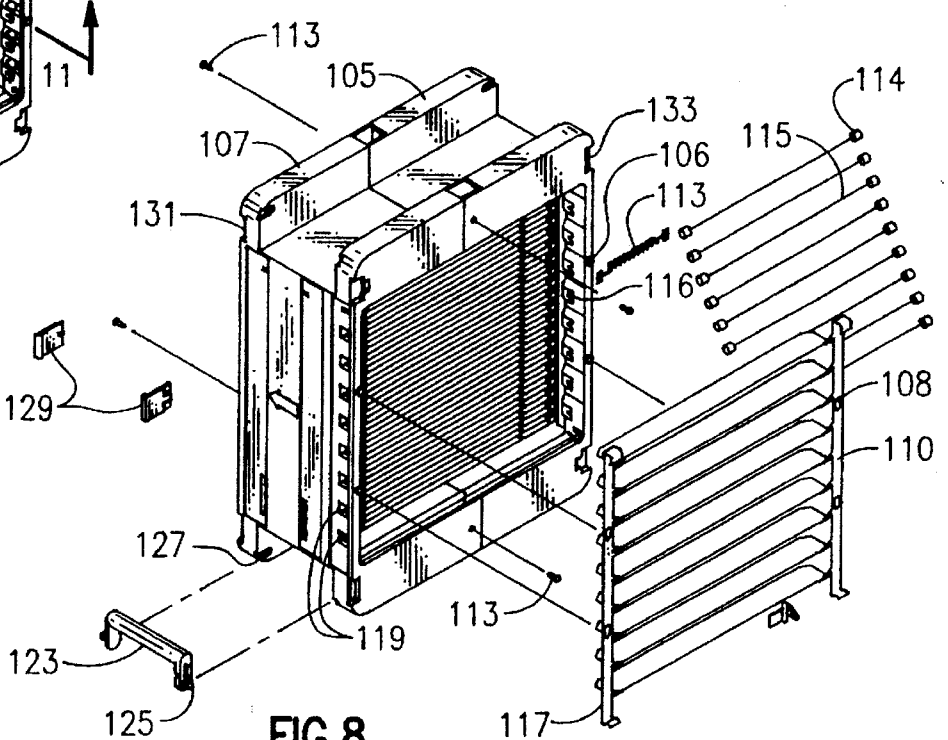
FIGS. 8 and 9 are expanded views of the air cleaner of the present invention.
Figure 9:
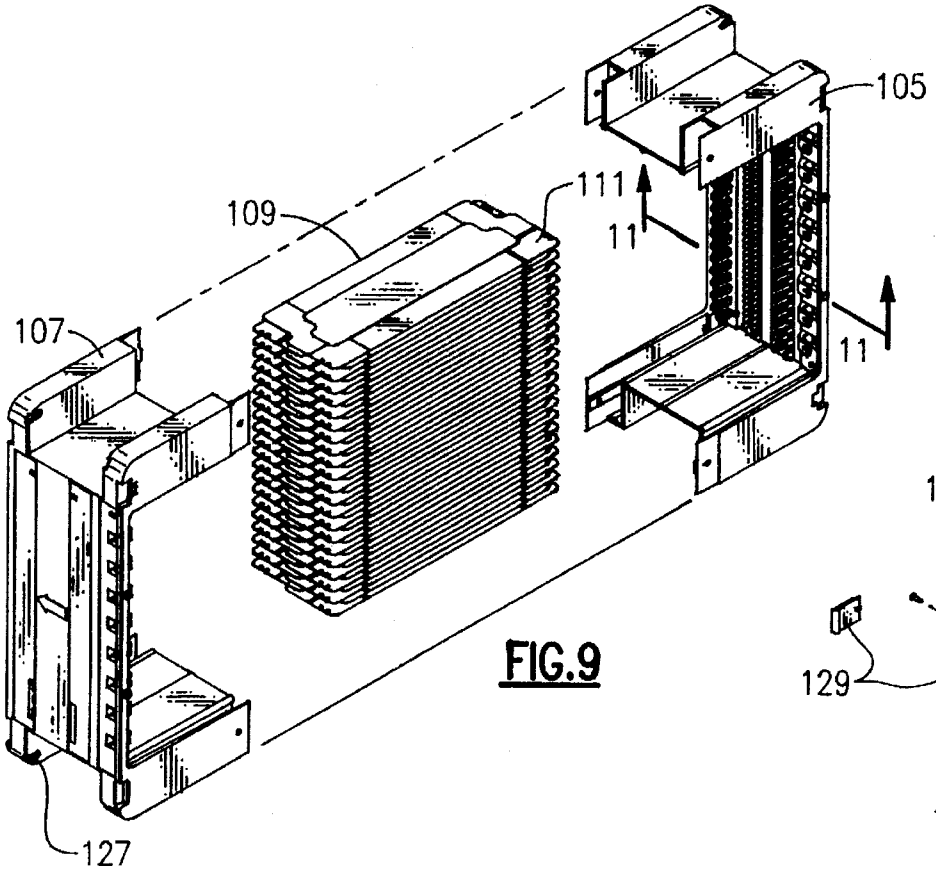
Figure 10:
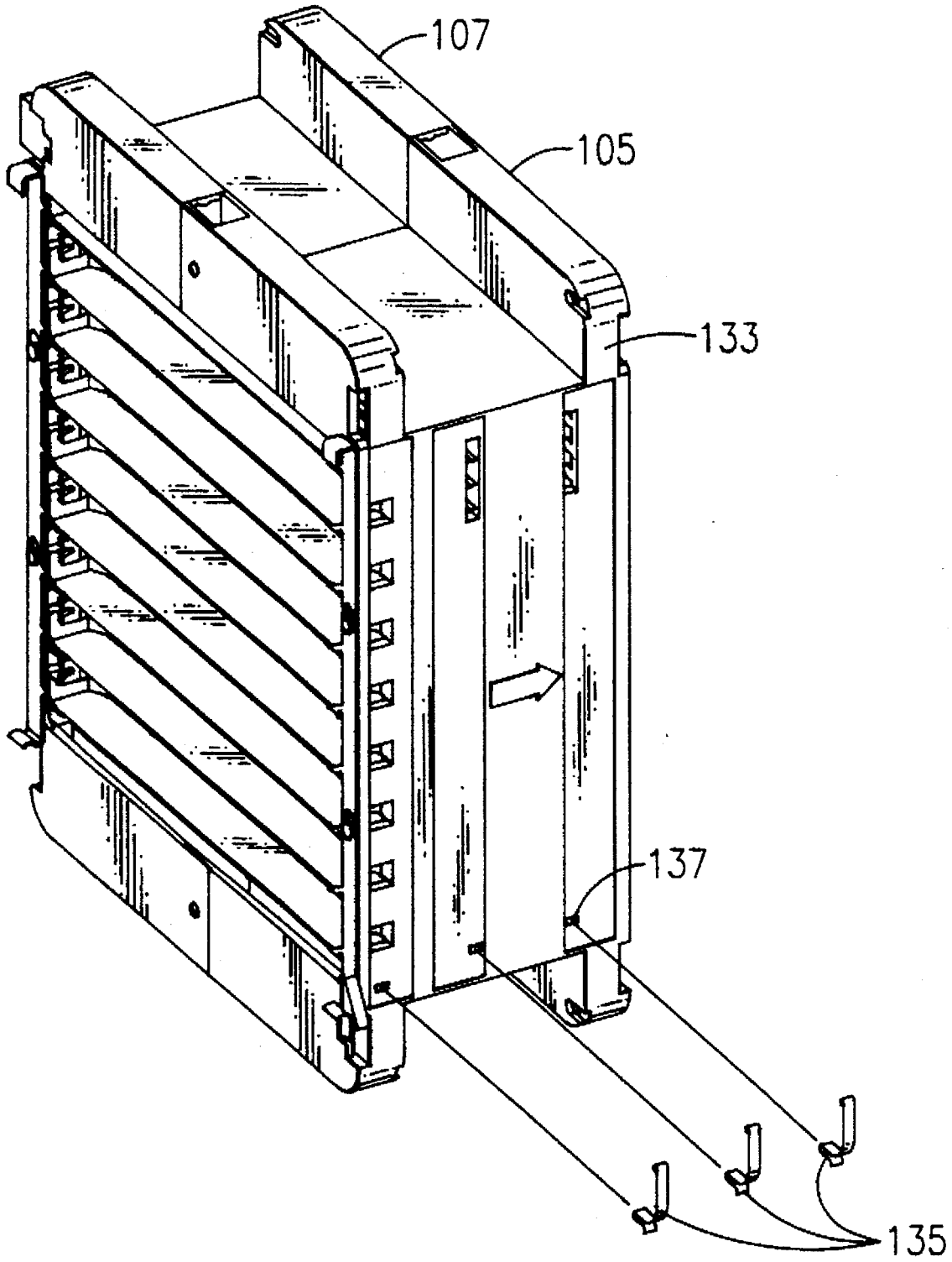
FIG. 10 is a rear perspective thereof.

The structure of a cell 17 as shown in FIGS. 8, 9 and 10 includes a pair of U-shaped frame members 105 and 107 with a plurality of transversely spaced aluminum collector plates 109 disposed therebetween. The collector plates 109 have tabs 111 on either side thereof which fit into grooves in the respective frame members 105 and 107. The frame members 105 and 107 have appropriate structure on the ends thereof so as to inter-mesh to form a rigid structure with only four fasteners 113 securing them together.

The frame members 105 and 107 are made of a suitable moldable plastic such as a thermoset polyester material which is commercially available from Rostone Corp. under the name ROSTITE. This material is generally non-conductive and therefore suitable for an insulated support structure for the high voltage collector plates 109. However, portions of the frame member 105 contain conductive material for purposes of providing electrical interconnection to the aluminum collector plates 109 in a manner to be described hereinafter.

Longitudinally spaced from the collector section on the upstream side thereof, is the ionizer section which includes the plurality of ionizer wires 115 and ground plates 117, all of which are mounted between the two frames members 105 and 107. The aluminum ground plates are attached to the frame members 105 and 107 by way of posts 106 on the frame members that pass through openings 108 in the supporting legs 110 of the ground plate 117. The ground plates are therefore at ground level voltage. The ionizer wires 115, on the other hand, have, on their ends, anchor lugs 114 that are mounted in grooves 116 of conductive portions of the frame members 105 and 106. In this way, they are interconnected to the high voltage source by the way in which they are mounted in the frame member 105 as will be more fully described hereinafter.

As will be seen in FIG. 8, a handle 123 is mounted by way of end pivots 125 in mounting holes 127 on either side of the frame member 107. This handle provides a convenient means for reaching in and grasping the handle to slide the cell 17 out from the casing, for purposes of cleaning and the like. At the top end of the frame member 107, on either side thereof is a cell clip 129 that is secured in a front slot 131 in such a manner as to extend laterally beyond the edge of the frame member 107 so as to engage a rear slot 133 of an adjacent cell. In this manner the two cells can be locked together for purposes of removal from the casing. That is, as the first cell is pulled out by way of the handle 123, the clips in its rear slot 133 grasp the cell which is laterally behind it and cause it to be pulled out with the first cell. The specific structure of the cell clips 129 will be described hereinafter.

As will be seen in FIG. 10, the rear side of a cell includes three stainless steel clips 135 which fit into openings 137 of the outer side of frame member 105 as shown and are held in place by barbs. These clips provide the electrical interconnection between the trace circuits in the back wall 81 and the conductive portions of the frame member 105 for purposes of providing the proper voltage levels to the collector plates and ionizer wires as will be more fully described hereinafter.

As mentioned hereinbefore, the frame member 105 must serve as both a plastic non-conductive support for alternate collector plates at ground voltage level and for the aluminum ground plates, as well as serving as a support for the alternate high voltage-charged aluminum collector plates and the ionizer wires. This is accomplished with the use of a hybrid molded material as shown in FIG. 11. The non-conductive portion 139 of the flame member 105 is composed of a plastic material which exhibits good insulating properties, such as the thermoset polyester material described above. The conductive portions 141, 143, and 145 are comprised of the same moldable plastic material, but with additives which cause the material to exhibit good electrical conductive characteristics. An example of a material which has been used for this purpose is a conductive carbon filler that is commercially available from Degussa as a super conductive carbon black identified as Printex-XE2. The conductive material is loaded into the appropriate areas of the die, in alternate arrangements, as shown. The non-conductive material is then placed on top of the conductive material so that the molded part has conductive strips encapsulated by non-conductive material. The dye is then compressed and heated to cure the materials as shown. As will be seen, the conductive portions 143 and 145 have three rows each of teeth 147 arranged in a staggered relationship such that the center row is offset from the side rows. This arrangement permits the tabs 111 of the collector plates 109 to be inserted therebetween in a friction fit relationship. As will be seen in FIG. 9, the tabs 111 are so arranged in alternate relationship, so that alternate conductive plates will be engaged with the conductive material 143 and 145, respectively, such that when the power is connected to the conductive materials 143 and 145, the conductor plates 109 will be alternately at high and low voltage conditions. For example, the first plate would have a tab which would be in contact with the conductive portion 145, but not in contact with the conductive portion 143. The second plate has a tab which is in electrical contact with only the conductive material 143, and not the conductive portion 145, and so on.

The third conductive portion 141 is provided for electrical connection to the ionizer wires 115. This interconnection is made by way of the lugs 114 and grooves 116 as described above. The various voltage levels are thus established as follows. The ground plates are set at ground voltage by a clip (not shown) which electrically interconnects one of the ground level trace circuits 82 directly to the support legs 110 of the aluminum ground plates 117. The ionizer wires are set at 8500 V by a clip 135 which engages the strip 141. The high voltage collector plates are set at 7500 V by a clip 135 which engages the strip 143. And the low voltage collector plates are set at ground by a dip 135 which engages the strip 145.

Referring now to FIG. 12, a clip 135 is shown in its installed position in an opening 137 in the frame member 105. Here, the conductive material is shown on the inner side (right side), with the non-conductive material being on the outer (left side). In fact, the conductive material may permeate only a portion of the structure as shown or the entire portion from the inside to the outside. It is only necessary that the clip 135 make electrical contact with the conductive portion thereof. This is accomplished by engagement of the dip in the opening 137, and also on the inner side by a barb 138 which also acts to hold it in place. The curved outer end of the clip 135 then makes contact with the appropriate trace circuit 82 of the back wall.

Figure 14:
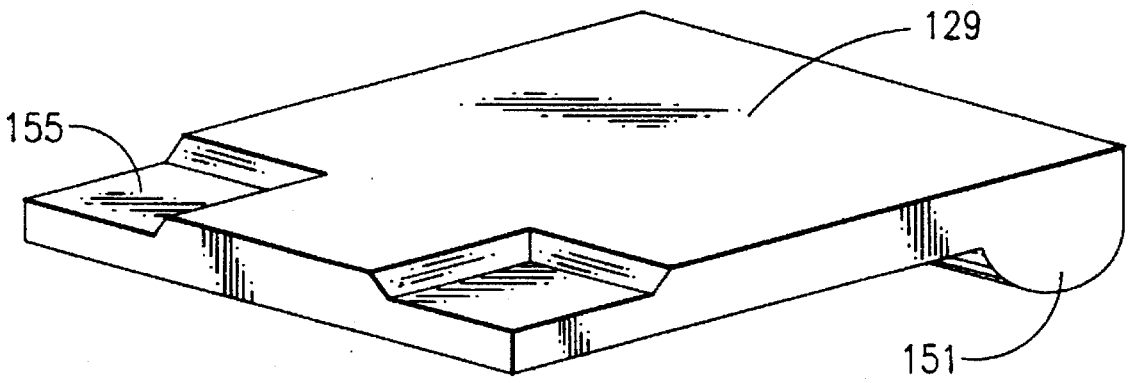
FIG. 14 is a perspective view of the interconnect clip.

Referring now to FIGS. 13 and 14, the cell clip 129 is shown with its one straight end installed in a slot 149 of a first, or front cell 17. The dip then extends laterally beyond the edge of the lateral side of the front cell 17, and beyond the lateral edge of the rear cell 17 such that its knob 151 then snaps into an opening 153 in the rear cell 17, as shown. Thus, the cell clip 129 is tightly installed in the slot 149 and is flexible to flex outwardly when its knob 151 reaches the edge of the rear cell. The flex bias of the clip then causes the knob 151 to move back into the opening 153 to lock the two cells together. A pair of relieved surfaces 155 are provided on one side of the clip 129 for purposes of locking it in place in its slot 149.

What is claimed is:

1. An improved electronic air cleaner having a containment structure for slideably receiving in one lateral end thereof, a pair of laterally aligned air cleaner cells, each cell having adjacent ionizer and collector sections arranged in serial flow relationship along a longitudinal axis, wherein the improvement comprises:

a handle formed on a side of one of the cells for use in grasping to facilitate the slideable removal of the cell from the containment structure;

connection means on a side of the other of said cells;

latching means attached to and extending from said one cell toward said other cell for engaging said connection means when said one cell is slidably installed next to said other cell and to cause said other cell to be slideably removed from the containment structure when said one cell is so removed.

2. An improved electronic air cleaner cell having longitudinally spaced ionizer and collector sections and adapted for lateral installation into and removal from a casing, comprising:

a frame member having transverse and lateral sides, said transverse sides extending substantially the transverse height of the casing, and said lateral sides extending substantially one half the lateral length of the casing;

said transverse sides each having a pair of longitudinally spaced openings for receiving a clip member therein;

clip members installed in each of one said pair of openings, said clip members extending laterally beyond an edge of a lateral side so as to engage the corresponding other pair of openings in an adjacent other cell to thereby lock the two cells together, such that when said one cell is removed, said other cell is also removed from the casing.

* * * * *